US005159136A

United States Patent [19]

Marsh

[11] Patent Number: 5,159,136

[45] Date of Patent: Oct. 27, 1992

[54] HANDGRIP MOUNTED CARTRIDGE CLIP AND MOLD THEREFOR

[76] Inventor: Brett A. Marsh, 1266 Whisperwood Dr., Columbus, Ga. 31907

[21] Appl. No.: 796,800

[22] Filed: Nov. 25, 1991

[51] Int. Cl.[5] ..... F41C 23/22

[52] U.S. Cl. ..... 42/71.01; 42/88

[58] Field of Search ..... 42/71.01, 71.02, 6, 42/49.01, 49.02, 50, 7, 87, 88, 89; 224/243, 245

[56] References Cited

U.S. PATENT DOCUMENTS

| | | | |
|---|---|---|---|
| 151,882 | 6/1874 | Jones | 42/71.02 |
| 394,376 | 12/1888 | Kelton | 42/71.01 |
| 684,055 | 10/1901 | Gabbett-Fairfax | 42/7 |
| 919,641 | 4/1909 | Rodgers | 42/71.01 |
| 972,087 | 10/1910 | Sunngard | 42/7 |
| 1,202,707 | 10/1910 | Grieco | 42/7 |
| 2,509,553 | 5/1950 | Wylie | 42/71.01 |
| 2,927,390 | 3/1960 | Lewis | 42/7 |
| 3,153,500 | 10/1964 | Pachmayr et al. | 42/87 |
| 4,437,252 | 3/1984 | Castellanos Manero | 42/89 |
| 4,619,063 | 10/1986 | Hill et al. | 42/7 |
| 4,860,478 | 8/1989 | Clayton | 42/71.01 |
| 4,888,900 | 12/1989 | Howard | 42/50 |

FOREIGN PATENT DOCUMENTS

| | | | |
|---|---|---|---|
| 339602 | 7/1921 | Fed. Rep. of Germany | 42/71.01 |

*Primary Examiner*—Michael J. Carone

*Attorney, Agent, or Firm*—Richard C. Litman

[57] ABSTRACT

A handgrip for a weapon having an opening extending from a bottom surface to a top surface, the opening defined by an elliptical cross-section and a tapered wall, and a cartridge clip defined by an elliptical cross-section and a tapered wall configured to frictionally engage the tapered wall of the handgrip. In a second embodiment, the tapered wall of the clip is provided with raised ribs, for increasing the frictional engagement of the tapered walls. The handgrip may also be provided with a distinctively colored notch to indicate that the clip has been pushed too far into the hollow handgrip. The clip is provided with a pivotally mounted pull ring to enable extraction of the clip from the hollow handgrip. The pull ring can be latched in an inoperative positive by a ring catch provided on the clip's base. The clip is molded of resilient rubber-like material. Also disclosed is a mold for molding the cartridge clip formed from two sides of a corresponding handgrip provided with a first flange having depending solid cylinders creating wells for receiving cartridges in the top of said cartridge clip, and a second flange having a projection configured to shape the base of said clip. For molding the second embodiment the inner surface of the two sides of the handgrip have grooves scored therein so as to provide ribs on the external wall of the clip, thereby increasing the frictional engagement between the tapered walls of the clip and the handgrip.

17 Claims, 3 Drawing Sheets 14
16a
18a
32
20a
22a
36
10a
34
40
28a
38

26a
24a
36a

HANDGRIP MOUNTED CARTRIDGE CLIP AND MOLD THEREFOR

BACKGROUND OF THE INVENTION

1. Field of the Invention

This invention relates to a cartridge clip for holding extra rounds of ammunition and the means for carrying the cartridge clip within a hollow handgrip of a pistol or rifle. With the rounds removed the cartridge clip can be used to hold water pills and/or other survival gear. This invention also relates to a mold for producing the cartridge clip, the mold being formed from two halves of the handgrip.

2. Description of Related Prior Art

U.S. Pat. No. 394,376, issued Dec.11, 1888 to John C. Kelton, disclosed a cartridge case having a clip means thereon enabling the case to be attached to elements such as a belt. When attached to a rifle the ammunition is exposed for easy access by the user. There is no disclosure by Kelton of inserting the cartridge case into a hollow handgrip or pistol grip.

U.S. Pat. No. 2,509,553 issued May 30, 1950 to George W. Wylie discloses a handgrip or pistol grip provided with a series of individual holes each configured to accommodate a single bullet, together with a single cover plate. There is no disclosure therein by Wylie of a cartridge clip carrying a plurality of bullets insertable into a handgrip or pistol grip.

U.S. Pat. No. 3,638,344, issued Feb. 1, 1972 to Karl Wagner et al., discloses a rifle stock with a detachable spare magazine contained therein, the magazine being releasably latched in a well in the side of the rifle stock. Neither the magazine nor the well structurally correspond to the invention disclosed and claimed in this application.

U.S. Pat. No. 4,115,943, issued Sep. 26, 1978 to Daniel D. Musgrove, discloses a reserve magazine holder connected to a rifle in a manner that is different than that described and claimed below in that the magazine is not fully covered by a hollow handgrip or pistol grip.

U.S. Pat. No. 4,850,127, issued Jul. 25, 1989 to William A. Davis et al., discloses a rifle stock having individual openings for accommodating individual bullets. There is no disclosure therein of a magazine containing a plurality of rounds inserted into a hollow handgrip or pistol grip.

SUMMARY AND OBJECTS OF THE INVENTION

It is an object of this invention to provide a cartridge clip which cooperates with a hollow handgrip or pistol grip to enable the insertion and extraction of the cartridge clip in the handgrip or pistol grip.

It is a further object of this invention to provide a cartridge clip which may be held in a hollow handgrip or pistol grip by friction without mechanical latching structure.

It is another object of this invention to form a mold for a cartridge clip from a hollow handgrip or pistol grip.

The above and other objects are achieved by providing handgrips or pistol grips having a hollow opening, with front and rear walls tapering from the bottom of the grip towards the top, with an insertable cartridge clip. The cartridge clip, which may be formed of a rubber type material is similarly provided with correspondingly tapered front and rear walls so as to provide an interference fit with the hollow openings when fully inserted into the hollow opening. The clip is provided with a plurality of wells (three wells in the preferred embodiment) for receiving cartridges, and with a folding pull ring for enabling extraction of the cartridge clip from the hollow handgrip or pistol grip. In the first embodiment, the engaging walls of the hollow handgrip and cartridge clip are smooth, relying solely on the coefficient of friction between the walls to retain the cartridge clip in the hollow opening.

In a second embodiment, the cartridge clip is provided with a plurality of ribs approximately 1/32 inch high and 1/16 inch wide designed to frictionally engage the smooth walls of the hollow opening in the handgrip or pistol grip. If found to be desirable, a safety notch having a red coloring may be provided in the hollow opening located so as to be visible near the base of the handgrip or pistol grip to visually indicate when a cartridge clip has been inserted too far into the hollow opening.

Also provided is a mold for molding the respective cartridge clip, the mold being formed from the respective halves of the handgrip or pistol grip. The inner surface of the respective halves of the handgrip or pistol grip may be configured to mold a cartridge clip having a smooth outer surface, or alternatively to provide a cartridge clip having a ribbed outer surface.

Other objects, features and advantages of this invention will become apparent from the following detailed description and the appended claims, reference being had to the accompanying drawings forming a part of the specification, wherein like reference numerals designate corresponding parts of the several views.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figures 1, 5, 6, 7, 8, 9:
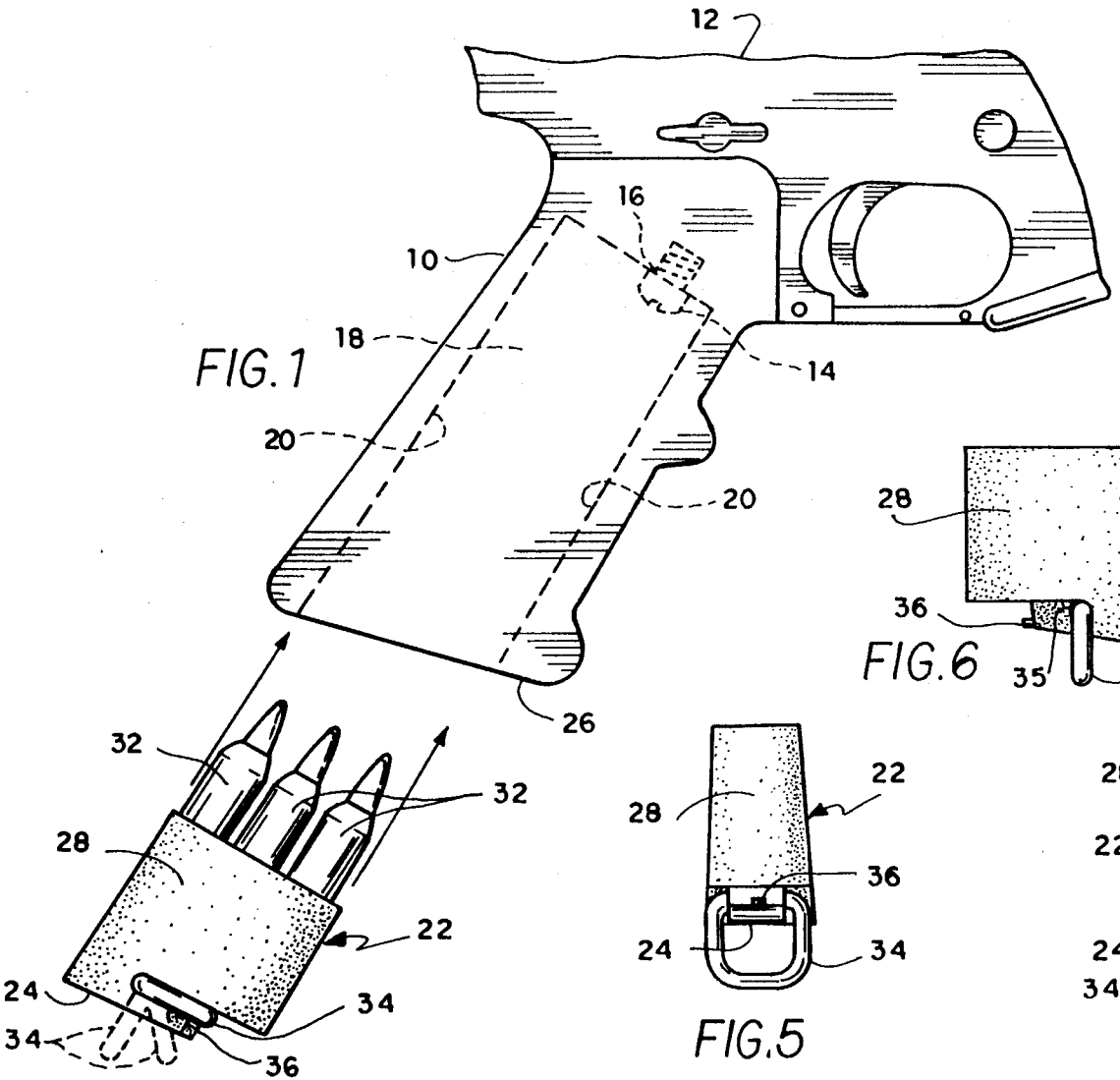
FIG. 1 is a side view showing the relationship between the cartridge clip and hollow handgrip of a conventional firearm.
FIG. 5 is a forward end view of the cartridge clip of FIG. 1 looking towards the pull ring mounting.
FIG. 6 is a side view of the cartridge clip of FIG. 1.
FIG. 7 is a rear end view of the cartridge clip of FIG. 1.
FIG. 8 is a bottom view of the cartridge clip of FIG. 1.
FIG. 9 is a top view of the cartridge clip of FIG. 1 showing the wells configured to hold the cartridges therein.

FIG. 1 shows a handgrip or pistol grip 10 of a colt AR-15/A2 weapon 12. While this handgrip has been selected to show the several features, it should be noted that this invention is applicable to any and all weapons having similar handgrips or pistol grips.

As is conventional, handgrip 10 is connected to weapon 12 by a single bolt or machine screw 14. Handgrip 10 has a generally elliptical cross-section, and tapers from the base 26 toward the top thereof. Bolt or machine screw 14 passes through a bolt opening 16 at the top of handgrip 10 to engage a tapped opening not shown but well known in weapon 14. Handgrip 10, as shown in FIG. 1, is also provided with a hollow opening 18 also having a generally elliptical cross-section and walls 20 which taper from the bottom to the top of the handgrip 10, the opening 18 being configured to receive a molded cartridge clip 22 with a frictional fit.

Cartridge clip 22 is formed of molded resilient material which may be rubber or yieldable plastic material having a configuration corresponding to the configuration of opening 18. Clip 22 is inserted into opening 18 until base 24 of clip 22 is substantially flush with base 26 of handgrip 10, at which point wall 28 of clip 22 frictionally engages wall 20 of opening 18 to hold clip 22 within handgrip 10.

Clip 22 is provided with three holes of wells 30 designed to receive three cartridges 32. In the specific example, the wells 30 each have a ⅜ inch diameter and are ¾ inch deep, although these dimensions will vary with different size weapons. With cartridges 32 removed, wells 30 may also hold water pills or other survival gear, not shown.

Clip 22 is also provide with a metal pull ring 34 pivotally mounted in a metal sleeve 35 on base 24 to enable extraction of clip 22 from opening 18. Normally, pull ring 34 is held in an inoperative or latched position substantially parallel to base 24 of clip 22 by a molded ring catch 36 in the form of a slightly enlarged projection or bump formed on base 24. When clip 22 is to be extracted from handgrip 10, pull ring 34 is released from catch 36 and is used to pull clip 22 from opening 18, whereby spare cartridges 32 or other items contained in holes or wells 30 become available to the user. FIGS. 5–9, inclusive, show various views of clip 22. In FIGS. 5, 6 and 7, pull ring 34 is shown in its released position. In FIG. 8, pull ring 34 is in its latched position held by catch 36. FIG. 9 provides a top view of clip 22 showing the positioning of holes or wells 30.

Figures 2, 3:
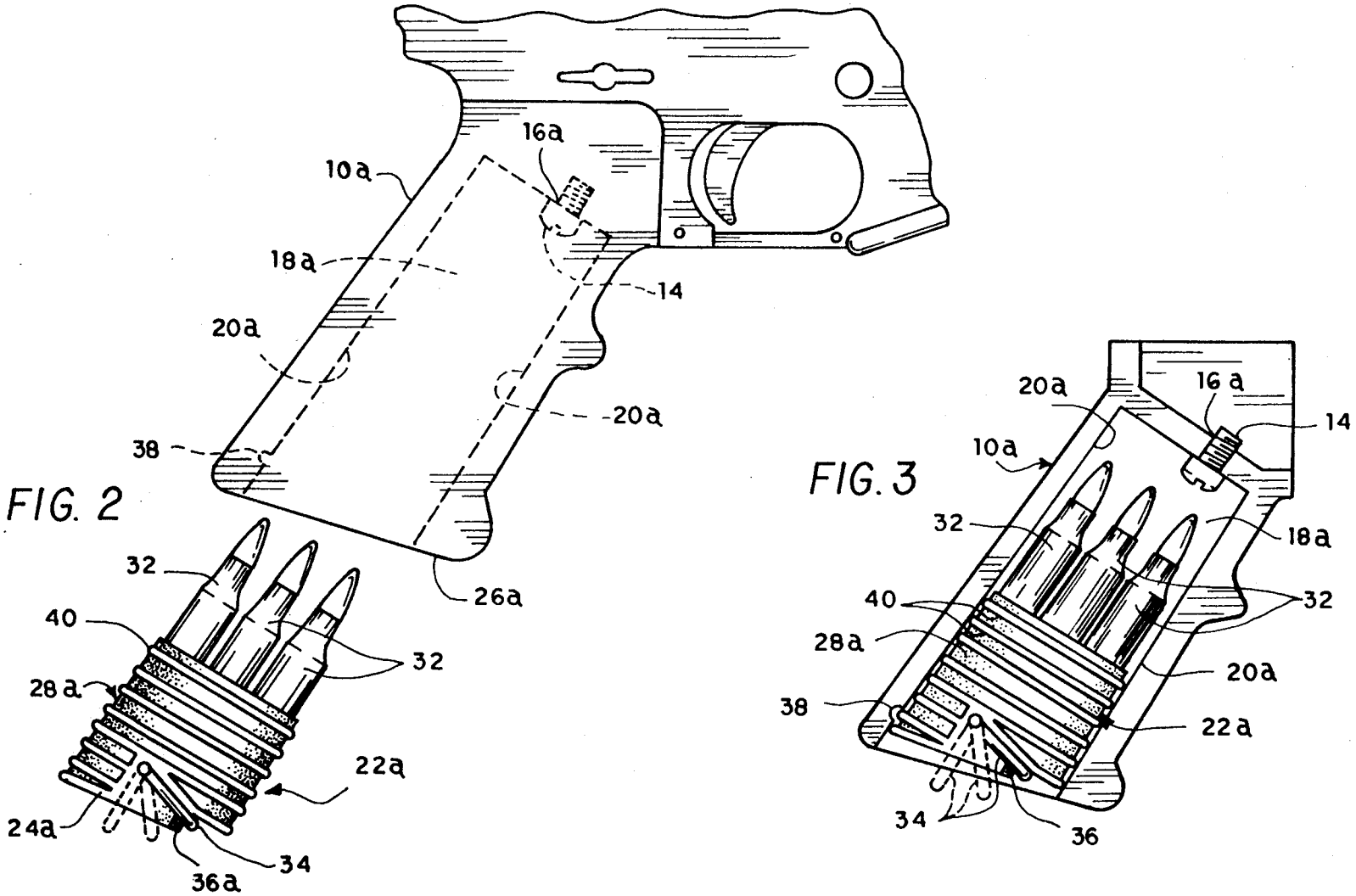
FIG. 2 is a side view showing a modified cartridge clip and a modified handgrip of the conventional firearm.
FIG. 3 is a side view showing the left side half of the handgrip with the cartridge clip of FIG. 2 fully inserted within the hollow opening.

FIG. 2 shows a second embodiment of the invention. Opening **18*a* in handgrip 10*a* is similar to opening 18 in hand grip 10 with one exception, namely safety notch 38 provided near the base 26*a* of handgrip 10*a* which may be painted red so as to be readily visible when a clip 22 or 22*a*, for example, has been pushed too far into opening 18*a* raising the possibility that the tip of a cartridge 32 may engage bolt or machine screw 14. Clip 22*a* is provided with ribs 40 to help retain clip 22*a* in opening 18*a* of handgrip 10*a*. In the embodiment shown, ribs 40** are 1/16 inch wide and have a height of approximately 1/32 inch.

FIG. 3 shows clip **22*a* properly inserted into opening 18*a*, with ribs 40 on wall 28*a* frictionally engaging wall 20*a* of opening 18*a* to hold clip 22*a* in position. As shown, red safety notch 38 is not visible, and becomes visible only if cartridge clip 22*a* (or 22) is either removed from handgrip 10*a* or (10) or is pushed too far into opening 18*a* (or 18**).

Figure 4B:
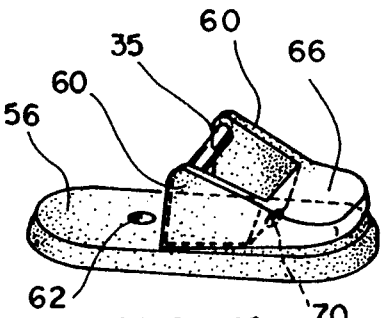
FIG. 4B is a perspective view of the bottom mold shown in FIG. 4, not drawn to scale.
Figure 4A:
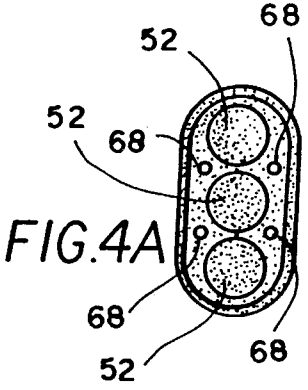
FIG. 4A is a bottom view of a portion of the top mold shown in FIG. 4.
Figure 4:
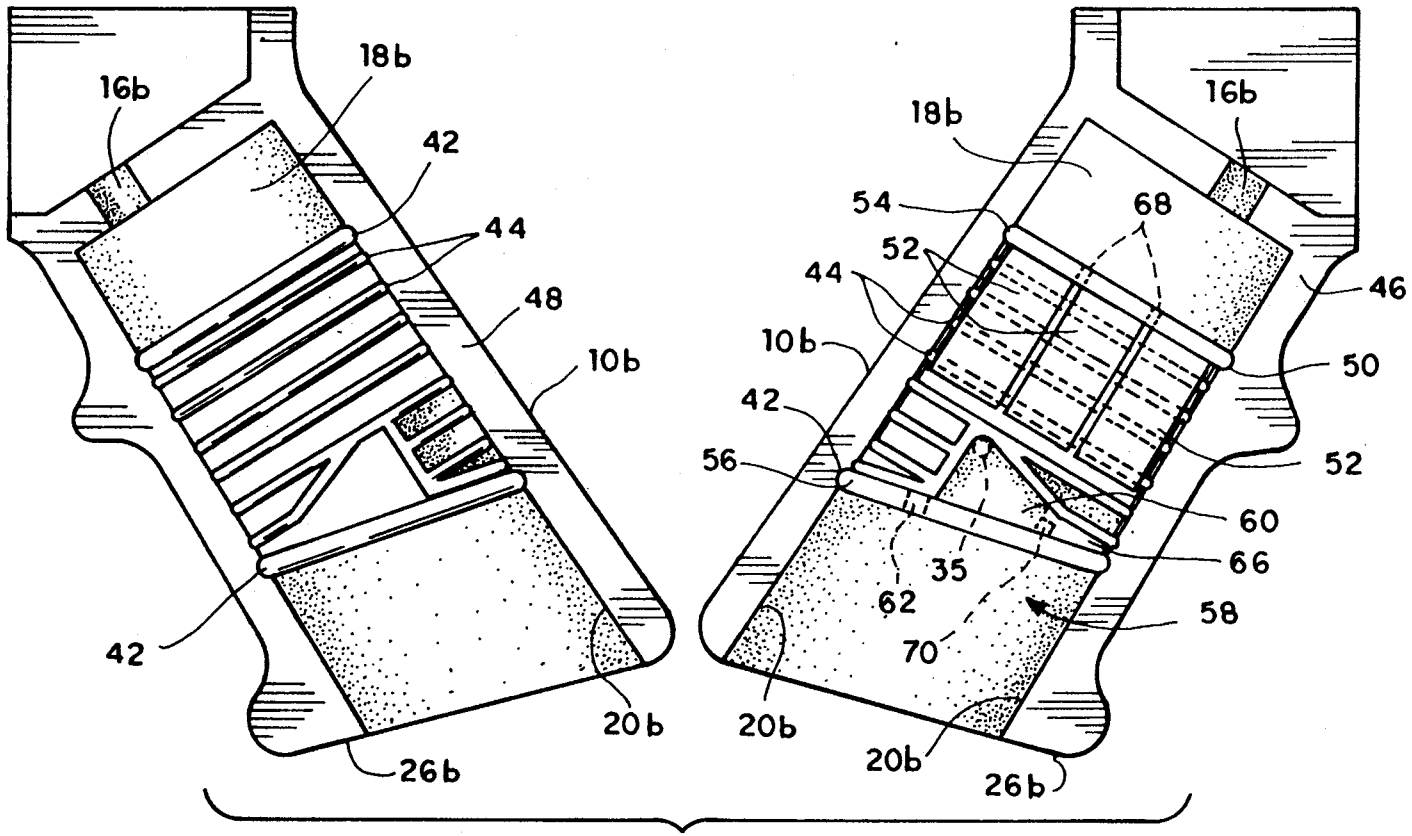
FIG. 4 is a side view of the handgrip configured to provide a mold for molding the cartridge clip of FIG. 2.

FIG. 4 shows a mold for forming clip **22*a* (second embodiment) wherein a handgrip 10*b* has been longitudinally cut in half to show two sets of different sized grooves 42 and 44 provided internally of opening 18*b*. As shown in FIG. 4, both the left side half 46 and the right side half 48 are provided with grooves 42 and 44. Also provided in left side half 46 is a top mold portion 50 having three depending solid cylinders 52 spaced approximately 1/32 inch apart, with the outer surface of the outside cylinders 52 spaced approximately 1/16 inch from the sidewall 20*b* of opening 18*b*. Cylinders 52 form the holes or wells in clip 22*a* similar to holes or wells 30 in clip 22. The upper flange 54 of mold portion 50 fits into the upper groove 42. Flange 56 of bottom mold portion 58 fits into bottom groove 42 and supports two inwardly disposed walls 60 supporting a metal sleeve 35 therebetween, and a portion 66 at one end of mold 58 includes a notch or indent 70 configured to form ring catch 36*a*. Flange 56 has at least one opening 62 to enable entry of the material to be molded, while upper flange 54 has at least one opening 68 to enable excess material to be molded to escape when left side half 46 and right side half 48 are joined together. The excess material can later be trimmed from the top and bottom surfaces of the molded cartridge clip. Grooves 42 are approximately 1/16 inch deep and ⅛ inch wide, while grooves 44** are approximately 1/32 inch deep and 1/16 inch wide.

A handgrip similar to handgrip **10*b* which includes only two wide groves similar to groves 42 for mounting a top mold portion 50 and a bottom mold portion 58 within an opening similar to opening 18*b* may be provided to mold a cartridge clip 22 having smooth walls, as shown in FIG. 1. Such a handgrip mold is well within the scope of the disclosed invention. The location of grooves 42 relative to a base similar to 26*b* would, of course, depend on the desired depth to which the cartridge clip 22 is to be inserted in an opening 18**.

The depth of openings 18, **18*a* and 18*b* for the handgrips 10, 10*a* and 10*b*** provided for a Colt AR-15/A2 is approximately 3 inches on the front short side and approximately 3½ on the back long side. It should be noted that handgrips or pistol grips for other weapons will have different dimensions for the hollow openings and cooperating cartridge clips.

While it will be apparent that the preferred embodiment of the invention herein disclosed is well calculated to fulfill the objects above-stated, it will be appreciated that the invention is susceptible to modification, variation and change without departing from the proper scope or fair meaning of the subjoined claims.

I claim:

1. A cartridge clip molded of rubber-like material for mounting in a hollow handgrip having a tapered internal wall, a base, and an opening in said base, said cartridge clip comprising:

a tapered external wall corresponding to the internal wall of said hollow handgrip;

a plurality of wells for receiving a plurality of cartridges; and a pull ring pivotally mounted on a base of said cartridge clip; whereby said cartridge clip may be inserted into said opening of said handgrip and held therein by frictional engagement between said tapered inner wall and said tapered external wall, and extracted from said opening of said handgrip by pulling on said pull ring.

2. A cartridge clip an in claim 1, wherein the external tapered wall of said clip is provided with ribs to increase the frictional engagement with the internal tapered wall of said handgrip.

3. A cartridge clip as in claim 1, said pull ring being formed of metal pivotally mounted in a metal sleeve molded into said base of said cartridge clip, said pull ring being held in an inoperative position by a molded ring catch provided on said base of said cartridge clip.

4. A cartridge clip as in claim 2, said pull ring being formed of metal pivotally mounted in a metal sleeve molded into said base of said cartridge clip, said pull ring being held in an inoperative position by a molded ring catch provided on said base of said cartridge clip.

5. A cartridge clip as in claim 1, wherein water pills and other survival gear may selectively be held in said wells as an alternative to said cartridges.

6. A cartridge clip as in claim 2, wherein water pills and other survival gear may selectively be held in said wells as an alternative to said cartridges.

7. A cartridge clip as in claim 3, wherein water pills and other survival gear may selectively be held in said wells as an alternative to said cartridges.

8. A cartridge clip as in claim 4, wherein water pills and other survival gear may selectively be held in said wells as an alternative to said cartridges.

9. A handgrip mounted cartridge clip comprising:

a handgrip for a weapon, said handgrip provided with a hollow opening with a tapered wall extending from a bottom surface of said handgrip towards a weapon engaging surface, said handgrip being connectable to a weapon by a machine screw extending through a weapon engaging surface; and a mating cartridge clip molded of rubber-like material, said mating cartridge clip including a tapered wall corresponding to the tapered wall of said handgrip, a plurality of wells for receiving a plurality of cartridges, and a pull ring pivotally mounted on a base of said cartridge clip; whereby said cartridge clip may be inserted into said hollow opening of said handgrip and held therein by frictional engagement between said tapered walls, and extracted from said hollow opening of said handgrip by pulling on said pull ring, thereby enabling the availability of said cartridges for use with a weapon.

10. A handgrip mounted cartridge clip as in claim 9, said handgrip further comprising a distinctly colored notch near said bottom surface within said hollow opening, the exposure of said notch after said clip has been inserted in said handgrip signaling the user that said clip has been inserted too far into said handgrip with possible damaging interference between a cartridge and said machine screw.

11. A handgrip mounted cartridge clip as in claim 9, wherein the tapered wall of said clip is provided with ribs to increase the frictional engagement with the tapered wall of said handgrip.

12. A handgrip mounted cartridge clip as in claim 10, wherein the tapered wall of said clip is provided with ribs to increase the frictional engagement with the tapered wall of said handgrip.

13. A handgrip mounted cartridge clip as in claim 9, said pull ring being formed of metal pivotally mounted in a metal sleeve molded into said base, said pull ring being held in an in operative positive by a molded ring catch provided on said base.

14. A handgrip mounted cartridge clip as in claim 10, said pull ring being formed of metal pivotally mounted in a metal sleeve molded into said base, said pull ring being held in an inoperative position by a molded ring catch provided on said base.

15. A handgrip mounted cartridge clip as in claim 11, said pull ring being formed of metal pivotally mounted in a metal sleeve molded into said base, said pull ring being held in an inoperative position by a molded ring catch provided on said base.

16. A handgrip mounted cartridge clip as in claim 12, said pull ring being formed of metal pivotally mounted in a metal sleeve molded into said base, said pull ring being held in an inoperative position by a molded ring catch provided on said base.

17. A handgrip mounted cartridge clip as in claim 9, wherein water pills and other survival gear may selectively be held in said wells as an alternative to said cartridges.

* * * * *